United States Patent [19]

Schleimer et al.

[11] 4,325,730

[45] Apr. 20, 1982

[54] PROCESS FOR CONDITIONING SLAG DURING THE REFINING OF A METAL BATH

[75] Inventors: Francois Schleimer, Dudelange; Romain Henrion, Esch, Alzette; Ferdinand Goedert, Dudelange; Lucien Lorang, Differdange; Jean Baumert, Esch, Alzette, all of Luxembourg

[73] Assignee: Arbed S.A., Luxembourg, Luxembourg

[21] Appl. No.: 204,537

[22] Filed: Nov. 6, 1980

[30] Foreign Application Priority Data

Nov. 7, 1979 [LU] Luxembourg ..... 81859

[51] Int. Cl.[3] ..... C21D 11/00; C21C 5/32; C21C 5/34

[52] U.S. Cl. ..... 75/52; 75/51; 75/59; 75/60; 266/78

[58] Field of Search ..... 75/51, 52, 59, 60, 49; 266/78

[56] References Cited

U.S. PATENT DOCUMENTS

| | | | |
|---|---|---|---|
| 3,663,204 | 5/1972 | Jungwirth | 75/60 |
| 3,719,469 | 3/1973 | Roessing | 75/60 |
| 3,854,932 | 12/1974 | Bishop | 75/49 |

*Primary Examiner*—P. D. Rosenberg
*Attorney, Agent, or Firm*—Karl F. Ross

[57] ABSTRACT

Slag is conditioned during blowing from above with oxygen of an iron melt by bubbling an inert gas into the melt from the bottom of the crucible in response to measurements made of the flowability of the slag layer and the speed of decarburization.

6 Claims, No Drawings

PROCESS FOR CONDITIONING SLAG DURING THE REFINING OF A METAL BATH

BACKGROUND OF THE INVENTION

The present invention relates to a process for conditioning a slag during refining of a metal bath, particularly an iron melt, by oxygen blowing upon the surface and by bubbling an inert gas through the bottom of the crucible.

FIELD OF THE INVENTION

Productivity imperatives have caused steel refiners to seek methods of incorporating a maximum of ferrous materials, e.g. scrap or rich minerals, into the bath. On the other hand one also seeks to assure a high quality of the fabricated steel by eliminating as much as possible the sulfur and phosphorus contained in the metal to be refined.

In order to attain these double goals it is known to monitor to the extent possible the evolution of the slag during refining and to intervene therein by controlling either the supply of oxygen blown by the lance or the height of the lance head above the bath level.

In fact, one iron-melt refining technique by blowing oxygen over the surface creates during the blowing above the bath a frothy slag which is strongly oxidic. It is possible to a certain degree to control the distribution of the blowing oxygen between the slag and the metal by varying the difference between the head of the lance and the level of the bath for a constant flow of oxygen and for a given configuration of the lance head.

A higher elevation of the lance head results in preferential oxidation of the slag and imparts thereto a frothy consistency which favors desulfurization and dephosphorization. By contrast, a lower height of the lance head induces an accelerated decarburization and an increased release of heat at the point of impingement of the oxygen jet, which heat is able to melt solid material incorporated in the bath.

In spite of the development of burdensome special lances for increasing the degree of post-combustion of carbon monoxide adjacent the surface of the bath, all efforts conceivable heretofore to increase the temperature adjacent the surface of the bath for the purpose of smelting the scrap surplus have been blocked by the presence on the surface of the bath of a thick layer of frothy slag which is formed the refining by oxygen blown onto the surface and which acts as a thermal insulator because of its frothy consistency.

OBJECT OF THE INVENTION

An object of the invention is to provide a refining process which permits increases above the traditional level of solid scrap added while completely avoiding the disadvantages described.

The process described in patent application LU No. 81.207 comprises refining a ferrous metal melt by oxygen blowing from above and is characterized in that, on one hand, one induces a post-combustion of carbon monoxide released during decarburization in the immediate proximity to the surface of the bath with oxygen and, on the other hand, by controlling the thickness and the consistency of the slag by inducing a disequilibrium between it and the bath by the injection of an essentially inert gas through the bottom of the bath.

However, the refining process in which the interface between the metal and the slag is constantly of inert gas renders the slag permanently deoxidized [oxygen deficient] and unable to assume a frothy consistency but does not take into consideration fully the multiple reactions which occur in the bath and in the slag.

In fact the slag should have a degree of controllable reactivity and thus an essentially fluid consistency which is equally controllable in order to permit refining under conditions recognized as favorable. At the same time it is necessary to follow instantaneously the degree of decarburization as a function of blowing oxygen.

SUMMARY OF THE INVENTION

This object is attained by the process according to the invention which is characterized by a continuous determination, on the one hand, of the consistency of the slag layer which overlies the bath and/or the level of this layer of slag and, on the other hand, of the speed decarburization of the bath, and adjustment of the flow rate of the bubbling gas in such manner as to assure that the level of the slag is disposed at a predetermined distance vis-a-vis the head of the lance and also that the slag maintains a fluid consistency.

One can determine the consistency of the slag layer for example by means measuring the intensity of the sound emitted by the blowing lance and an indication of the level of the slag layer can be obtained by measurement, of the hydrostatic pressures which prevail at the different levels of the wall of the crucible. In order to follow the speed of decarburization of the bath one can determine continuously the composition of the vapors of the converter, preferably with the aid of a mass spectrometer.

The idea which underlies the present invention can be formulated as follows: There is an optimum conditioning of the slag from the point of view of consistency and reactivity, which resutls in a favorable combination of the effects of post-combustion of carbon monoxide and the dephosphorization/desulfurization. It should then be possible to condition the slag, by controlling the rate of flow of the bubbling gas, by the use of measuring means which permit monitoring of the localized behavior of the slag, i.e. of its thickness as well as its level in the crucible.

While maintaining the distance between the head of the lance and the slag at a predetermined value, one varies according to the invention, the oxygen blown between the metal and the slag by increasing, according to the monitoring results, the flow rate of the bubbling gas in order to deoxidize the slag and by decreasing said flow rate in order to favor oxidation of the slag. The flow rate of the bubbling gas is varied between 0 and 0.3 $Nm^3$/t-min [N=standard, $m^3$=cubic meter, t=metric ton, min=minute].

It must be understood that by deoxidizing the slag by augmenting the rate of flow of the bubbling gas, one increases the post-combustion of carbon monoxide liberated during the course of refining, above the level of the bath. It is therefore possible to act upon the thermal conditions obtaining above the level of the bath by conditioning the slag with the aid of control of the rate of flow of the bubbling gas.

Following the same reasoning one can, in accordance with the invention, bring about a dephosphorization and desulfurization reaction in the bath by forming, which controlling the rate of flow of the bubbling gas, a reactive, non-frothy slag. In fact, a decrease in said rate permits oxidation of the slag, a condition which increases its reactivity.

Thus, while following the conventional processes of refining, one attempts as much as possible to control the speed of decarburization of the bath by the oxygen blowing, by adjustment of the height of the lance and also by regulating the head of the lance with whose aid one can choose the angle of oxygen blowing, the method according to the invention providing that the lance is confined practically to the role of simply furnishing oxygen and that control of the speed of decarburization of the metal is regulated by the rate of flow of the bubbling gas.

In fact, one increases the speed of decarburization by increasing the rate of flow of the bubbling gas and one slows it down by decreasing said rate of flow in accordance with the indication of the monitoring system.

Thus it is apparent that one can act on the speed of decarburization by conditioning the slag. In fact, the deoxidation of the slag which is brought about by means of augmenting the rate of flow of the bubbling gas, is effected in part by the accelerated combustion of carbon which is carried toward the more or less oxidized slag with the aid of the bubbling gas.

Finally, the conditioning of the slag is carried out in accordance with the invention, by means of halting the bubbling with inert gas so that the slag rises which promotes removal of encrustations on the lining.

For measurement means which are effective in accordance with the invention and by which one continuously determines the consistency of the layer of slag and the height of the level in the crucible, the procedures and indicators of measurement described by applicant in his LUxembourg patent LU No. 71.261 or the patent application LU No. 81.512 are utilized.

These procedures and devices lend themselves well for their integration in a global system for control and regulation convenient for use within the framework of the process outlined in the invention. The same is applicable to the monitoring of the speed of decarburization by analysis of the content of the vapors of the process with the aid of a mass spectrometer.

We claim:

1. In a process for refining an iron melt in a crucible overlain by a slag layer tending upon oxidation of the slag to assume a frothy nonfluid consistency, the improvement which comprises, in combination, the steps of:

(a) blowing oxygen onto the top of said melt from a lance head disposed thereabove;

(b) continuously measuring the flowability of said layer of slag and the level of said layer and the speed of decarburization of the bath; and (c) bubbling an inert gas into said melt from the bottom of said crucible at a rate of flow controlled in response to the measurements obtained in step (b) to maintain the level of the slag at a predetermined distance from said head of said lance while preventing said slag from frothing and the decarburization at a maximum under the condition of maintaining the level of said slag at said predetermined distance from said head and said slag in a nonfrothy character.

2. The method defined in claim 1 wherein the rate of flow of the bubbling gas is up to 0.3 $Nm^3$/t-min.

3. The method defined in claim 2 wherein the degree of post-combustion of the carbon monoxide released over the bath during the course of refining is regulated by regulating the rate of flow of the bubbling gas.

4. The process defined in claim 2 wherein the rate of flow of the bubbling gas is increased to accelerate combustion of carbon of the bath and is decreased to slow said combustion.

5. The process defined in claim 2 wherein the slag is conditioned at the end of blowing by reducing the rate of flow of the bubbling gas to a minimum.

6. The process defined in claim 2 wherein the sound emitted by the lance, the hydrostatic pressure of the melt and the composition of vapors from the melt are handled by a microprocessor controlling the bubbling of gas into the melt from the bottom of the crucible.

* * * * *